US008313047B2

(12) United States Patent
Micheli

(10) Patent No.: US 8,313,047 B2
(45) Date of Patent: Nov. 20, 2012

(54) SPRAY GUN HAVING ADJUSTABLE HANDLE

(76) Inventor: Paul R. Micheli, Glen Ellyn, IL (US)

( * ) Notice: Subject to any disclaimer, the term of this patent is extended or adjusted under 35 U.S.C. 154(b) by 295 days.

(21) Appl. No.: 11/953,766

(22) Filed: Dec. 10, 2007

(65) Prior Publication Data

US 2009/0148612 A1 Jun. 11, 2009

(51) Int. Cl.
*B05B 7/02* (2006.01)

(52) U.S. Cl. ..... 239/526; 239/587.6

(58) Field of Classification Search ..... 239/289, 239/525–528, 530, 587.1–587.6
See application file for complete search history.

(56) References Cited

U.S. PATENT DOCUMENTS

| | | | | |
|---|---|---|---|---|
| 1,511,361 | A * | 10/1924 | Paasche | 239/415 |
| 1,840,488 | A * | 1/1932 | Connell | 239/525 |
| 1,961,481 | A * | 6/1934 | Downs | 239/415 |
| 4,518,122 | A * | 5/1985 | Ballu | 239/530 |
| 4,660,774 | A | 4/1987 | Kwok et al. | |
| 5,064,123 | A * | 11/1991 | Aiello et al. | 239/706 |
| 5,395,046 | A * | 3/1995 | Knobbe et al. | 239/3 |
| 5,765,753 | A | 6/1998 | Kieffer | |
| 5,887,800 | A * | 3/1999 | McClosky | 239/587.1 |
| 5,947,388 | A * | 9/1999 | Woodruff | 239/532 |
| 5,971,298 | A * | 10/1999 | Millan et al. | 239/290 |
| 6,019,294 | A | 2/2000 | Anderson et al. | |
| 6,098,902 | A | 8/2000 | Culbertson et al. | |
| 6,508,415 | B2 | 1/2003 | Wang | |
| 6,511,001 | B1 * | 1/2003 | Huang | 239/526 |
| 6,702,198 | B2 | 3/2004 | Tam et al. | |
| 6,719,212 | B1 | 4/2004 | Leisi | |
| 6,854,667 | B2 | 2/2005 | Ulrich et al. | |
| 6,874,702 | B2 | 4/2005 | Turnbull | |
| 7,032,839 | B2 | 4/2006 | Blette et al. | |
| 2006/0049283 | A1 | 3/2006 | Lee | |
| 2008/0295768 | A1 | 12/2008 | Micheli et al. | |

FOREIGN PATENT DOCUMENTS

| | | |
|---|---|---|
| DE | 562872 | 10/1932 |
| EP | 0804969 | 11/1997 |

* cited by examiner

*Primary Examiner* — Christopher Kim
(74) *Attorney, Agent, or Firm* — Fletcher Yoder, P.C.

(57) ABSTRACT

A spray coating device having a an adjustable handle is provided. The adjustable handle can be extended or folded relative the body of the spray coating device. This provides the user with an ability to easily manipulate and move the spray coating device. The spray coating device also includes a plurality of molecular components adapted to ease replacement at ports within the spray coating device.

25 Claims, 4 Drawing Sheets

SPRAY GUN HAVING ADJUSTABLE HANDLE

BACKGROUND

The present technique relates generally to spray coating devices, such as spray guns used to apply paint and other finishing products onto a product. More specifically, the present technique relates to a modular adjustable spray coating device.

Spray coating devices, such as spray guns, typically include a variety of fixed or integrated components, such as air and liquid valves, passages, handles, orifices, and so forth. For example, the components of the spray gun may be permanently coupled and/or fused with one another, rendering the spray gun rigid and inflexible for use in certain situations. For example, the handle of the spray gun may be permanently fused to the body of the spray gun, thus, hindering or otherwise depriving a user's ability to spray coat surfaces not easily accessible for the user. Such a surface may include or may be adjacent to corners, openings, or other irregularly shaped structures. For example, the surface may be within a narrow passage or interior structure, which blocks or severely limits entry and/or movement of the stiff and relatively bulky spray gun. In other words, the spray gun's permanent physical shape and dimensions may limit the spray gun's versatility, rendering it suitable for use only in certain spray coating operations. This may require the user to employ multiple spray guns, thereby complicating and prolonging the spray coating operation. In addition, the permanent shape of the spray gun may render the spray gun's storage and handling more difficult. For example, the spray gun may occupy a substantial space or otherwise may not optimally fit within storage devices, such as a tool box.

BRIEF DESCRIPTION

A system, in certain embodiments, may include a spray coating device that includes a body and a handle coupled to the body, such that the handle is movable relative to the body. In addition, the body, the handle, or a combination thereof, comprises a split shell configured to enclose one or more modular components of the spray coating device. In another exemplary embodiment, a spray coating device includes a handle comprising a pivot joint configured to rotate the handle among a plurality of angular positions relative to a body of the spray gun, such that the plurality of angular positions comprise a generally parallel position and a generally crosswise position relative to the body.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
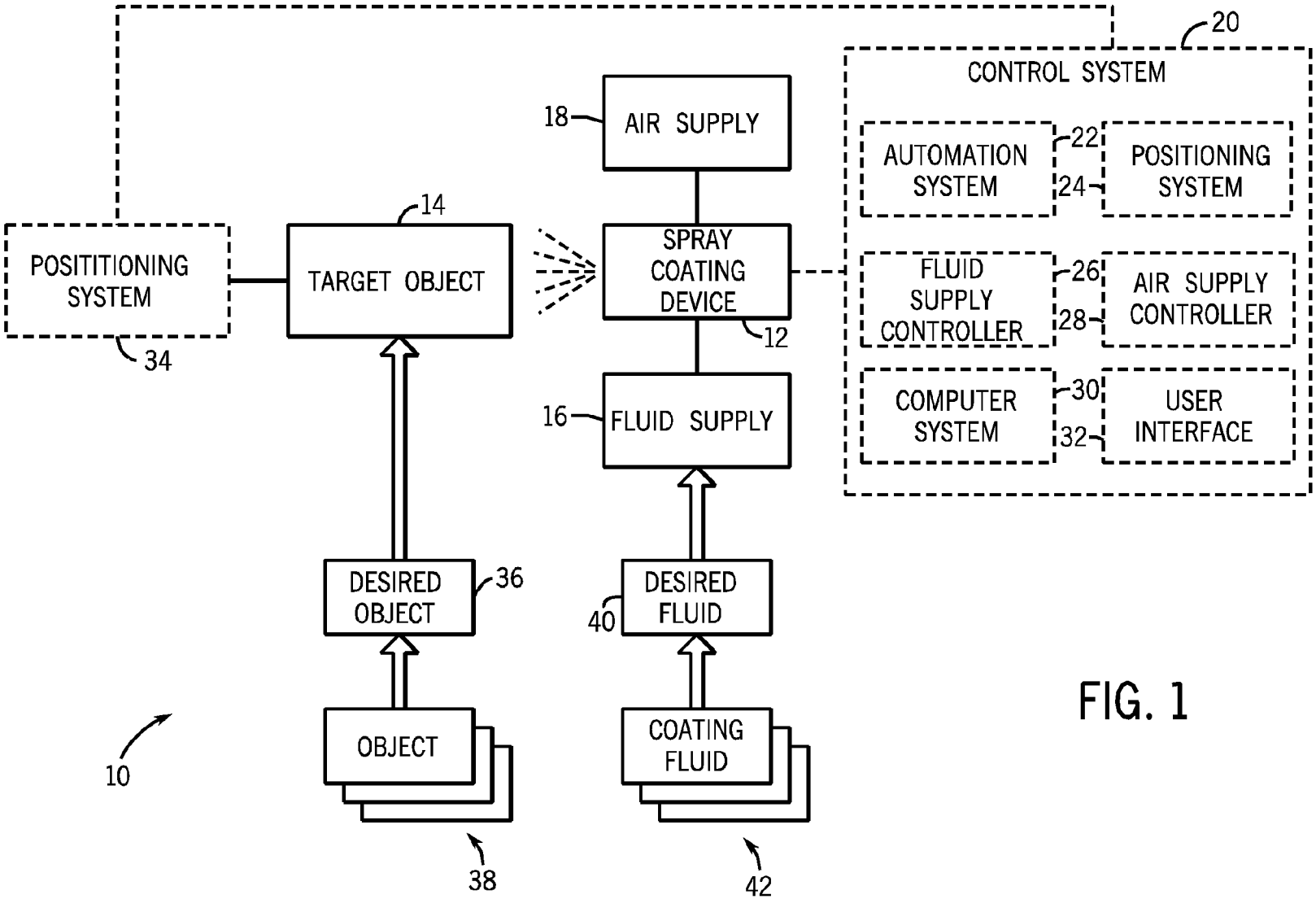
FIG. 1 is a diagram illustrating an embodiment of a spray coating system.

FIG. 1 is a flow chart illustrating an embodiment of a spray coating system 10, which includes a spray coating device 12 (e.g., spray gun) for applying a desired coating to a target object 14. For simplicity, the spray coating device 12 will be described as a spray gun in the following description, although various embodiments of the spray coating device 12 may or may not have a gun-shaped body. As discussed in further detail below, the spray gun 12 may have an adjustable handle configured to fold or extend relative to the body of the spray gun. The adjustable handle may be folded or extend through an angle ranging from about 90 to 180 degrees in a continuous or in an intermittent fashion. That is, in one embodiment, a user may continuously extend/fold the handle to any desired position, while in other embodiments, the handle of the spray gun may interlock along equally or unequally preset positions as the spray gun extends/folds. The adjustable feature enables the user to employ the spray gun in a variety of positions, thus, accommodating the user's needs for optimally performing spray coating operations. Thus, the user may be able to reshape the handle of the spray gun for easily accessing regions that would otherwise be obscure and inaccessible to conventionally shaped spray guns. The spray gun may further include a plurality of modular components, such as an air valve, a liquid valve, conduits, levers, and so forth. In some embodiments, each module is a self-contained functional unit, which includes a housing surrounding functional elements, passages, seals, valves, or other elements. As a result, each unit can be easily assembled and disassembled within the split case to add, remove, or change the functionality without the complication of many small parts typically associated with the unit. Thus, the modular components can be quickly and easily accessed, replaced, repaired, or serviced at any time.

The illustrated spray gun 12 may be coupled to a variety of supply and control systems, such as a fluid supply 16, an air supply 18, and a control system 20. The control system 20 facilitates control of the fluid and air supplies 16 and 18 and ensures that the spray gun 12 provides an acceptable quality spray coating on the target object 14. For example, the control system 20 may include an automation system 22, a positioning system 24, a fluid supply controller 26, an air supply controller 28, a computer system 30, and a user interface 32. The control system 20 also may be coupled to a positioning system 34, which facilitates movement of the target object 14 relative to the spray gun 12. According, the spray coating system 10 may provide a computer-controlled mixture of coating fluid, fluid and air flow rates, and spray pattern. Moreover, the positioning system 34 may include a robotic arm controlled by the control system 20, such that the spray gun 12 covers the entire surface of the target object 14 in a uniform and efficient manner.

Spray coating system 10 of FIG. 1 is applicable to a wide variety of applications, fluids, target objects, and types/configurations of the spray gun 12. For example, a user may select a desired fluid 40 from a plurality of different coating fluids 42, which may include different coating types, colors, textures, and characteristics for a variety of materials such as metal and wood. The user also may select a desired object 36 from a variety of different objects 38, such as different material and product types. As discussed in further detail below, the spray gun 12 also may comprise a variety of different components and spray formation mechanisms to accommodate the target object 14 and the fluid supply 16 selected by the user. For example, the spray gun 12 may comprise an air atomizer, a rotary atomizer, an electrostatic atomizer, or any other suitable spray formation mechanism.

Figure 2:
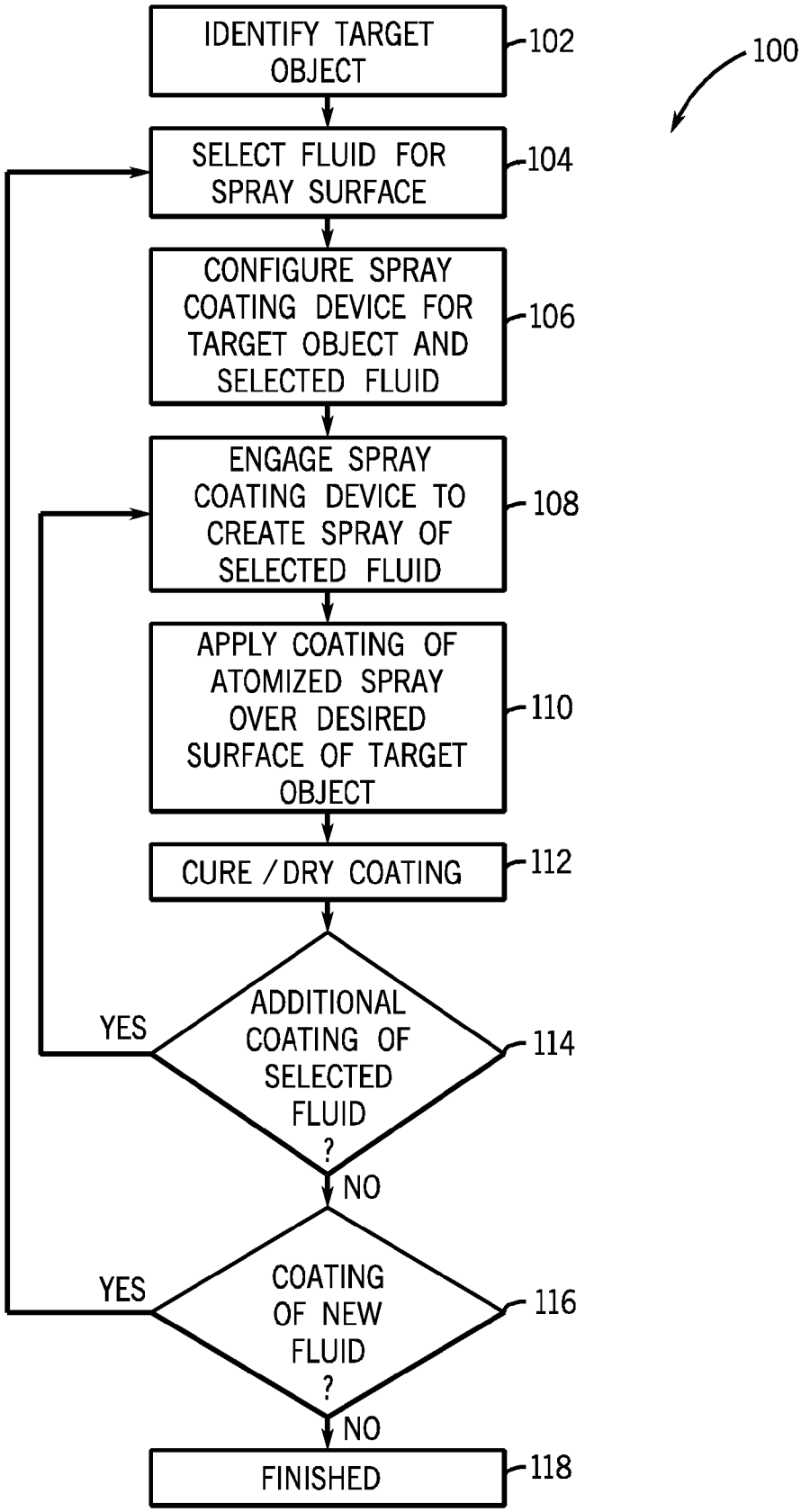
FIG. 2 is a flow chart illustrating an embodiment of a spray coating process.

FIG. 2 is a flow chart of an embodiment of a spray coating process 100 for applying a desired spray coating to the target object 14. As illustrated, process 100 proceeds by identifying target object 14 for application of the desired fluid (block 102). Process 100 then proceeds by selecting desired fluid 40 for application to a spray surface of the target object 14 (block 104). A user may then proceed to configure spray gun 12 for the identified target object 14 and selected fluid 40 (block 106). For example, the user may rotate a handle of the spray gun 12 to a desired angular position, e.g., between 90 and 180 degrees. The user also may assemble various modular components of the spray gun 12 within a hollow shell defining the gun 12. As the user engages spray gun 12, process 100 then proceeds to create an atomized spray of selected fluid 40 (block 108). The user may then apply a coating of the atomized spray over the desired surface of target object 14 (block 110). Process 100 then proceeds to cure/dry the coating applied over the desired surface (block 112). If an additional coating of selected fluid 40 is desired by the user at query block 114, then process 100 proceeds through blocks 108, 110, and 112 to provide another coating of the selected fluid 40. If the user does not desire an additional coating of the selected fluid at query block 114, then process 100 proceeds to query block 116 to determine whether a coating of a new fluid is desired by the user. If the user desires a coating of a new fluid at query block 116, then process 100 proceeds through blocks 104-114 using a new selected fluid for the spray coating. If the user does not desire a coating of a new fluid at query block 116, then process 100 is finished at block 118.

Figure 3:
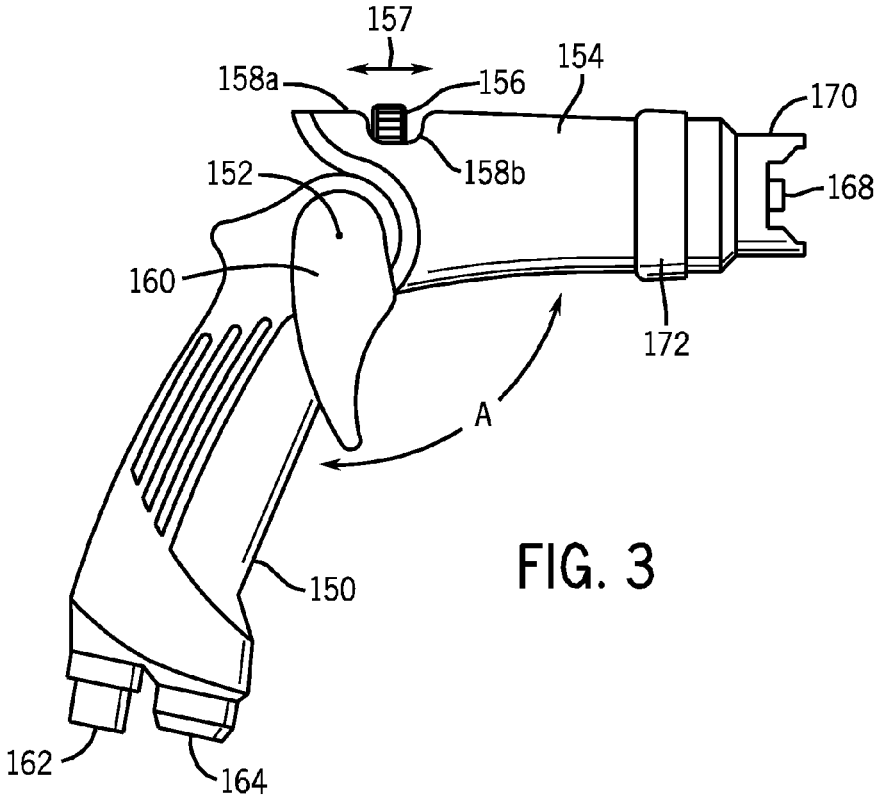
FIG. 3 is a side view of an embodiment of an adjustable handle spray gun disposed in a gun-shaped profile.
Figure 4:
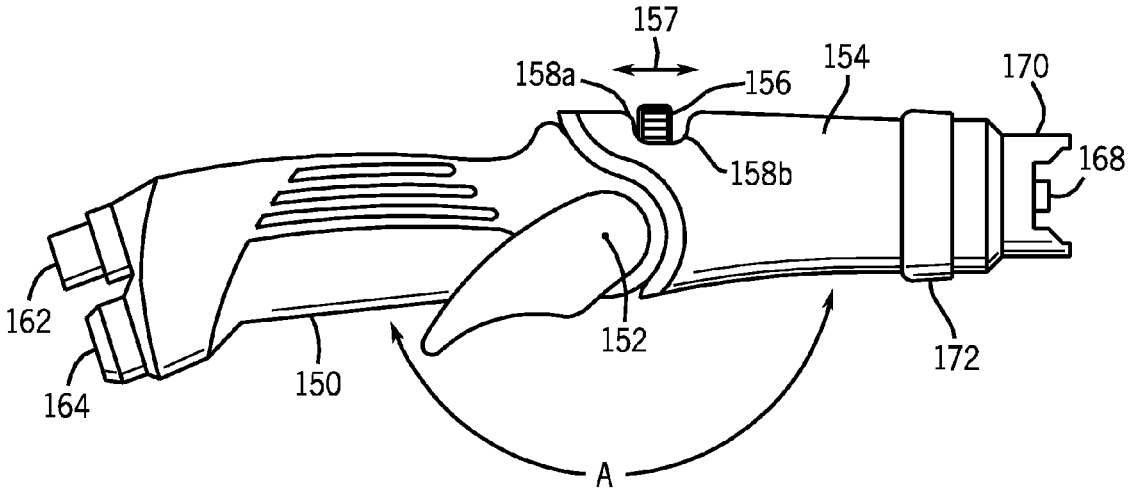
FIG. 4 is a side view of an embodiment of an adjustable handle spray gun disposed in an elongated or low profile.

FIGS. 3 and 4 are side views of the adjustable handle spray gun 12 in accordance with an embodiment of the present technique. The embodiments illustrated in FIGS. 3 and 4 depict different handle configurations of the spray gun 12, as well as the manner by which the spray gun 12 rotates or adjusts between different handle configurations. Accordingly, the spray gun 12 includes a handle 150 adapted to pivot about a pivot point 152. The handle 150 is adapted to expand and retract, e.g., rotate back and forth relative to spray gun casing 154. For example, as shown in FIG. 3, the handle 150 may rotate to an obtuse angle A (i.e., between 90 and 180 degrees) relative to the casing 154. In other embodiments, the handle 150 of the spray gun 12 may rotate to another angle A between the handle 150 and the casing 154. For example, the angle A may be less, greater, or equal to 90 degrees. By further example, as shown in FIG. 4, the handle 150 may fully expand or unfold relative to casing 154 so that the angle A becomes about 180 degrees (e.g., 180+/−1, 2, 3, 4, 5, 6, 7, 8, 9, or 10 degrees). Thus, the handle 150 may rotate between a gun-shaped profile as shown in FIG. 3 and an elongated or low profile as shown in FIG. 4. The gun-shaped profile of FIG. 3 also may be described as an L-shaped profile, a partially folded profile, a crosswise profile, a transverse profile, and so forth. Moreover, the elongate or low profile of FIG. 4 may be described as an I-shaped profile, a completely unfolded profile, a parallel expanded profile, and so forth. In some embodiments, the handle 150 also may fold inwardly on the casing 154 like a jackknife. In other words, the angle A may be substantially reduced to an acute angle at least approaching zero degrees (e.g., less than 10, 20, 30, 40, or 50 degrees). In such a configuration (e.g., acute angle), the profile of the spray gun 12 may be described as a generally or fully folded profile, a closed clamshell profile, a closed jackknife profile, a parallel retracted profile, and so forth. Again, the profile of the spray gun 12 can be easily adjusted by rotating the handle 150 relative to the casing 154.

The adjustable handle feature of the spray gun 12 is enabled by a movable mechanical switch 156, which the user can actuate to pivot and retract the handle 150, as described above. As illustrated by arrow 157, the switch 156 is movable between two positions, namely, positions 158*a* and 158*b*. In an exemplary embodiment, the switch 156 may lock, e.g., snap into the two locking positions 158*a* and 158*b*, such that the handle 150 can be unlocked, rotated, and then locked in the desired angular position (e.g., FIGS. 3 and 4). For example, the position 158*a* may lock the angular position of the handle 150, such that the desired profile (e.g., FIG. 3 or 4) is secure. The position 158*b* may unlock or release the angular position of the handle 150, such that the user can rotate the handle 150 inwardly or outwardly from the casing 154 to the desired angle A. In some embodiments, the handle 150 may rotate smoothly and continuously between countless angles A relative to the casing 154. In other embodiments, the handle 150 may step, click, or snap into one discrete angle A after another. For example, the handle 150 may be rotatable between 2, 3, 4, 5, 6, 7, 8, 9, 10, or more angular positions relative to the casing 154. By further example, these discrete positions may include 0, 10, 20, 30, 40, 45, 50, 60, 70, 80, 90, 100, 110, 120, 130, 140, 150, 160, 170, and 180 degrees for the angle A. In alternate embodiments, the switch 156 may be moved to position 158*a* to automatically snap (e.g., spring bias and lock) the handle 150 into a first profile (e.g., FIG. 3), and then may be moved to position 158*b* to automatically snap the handle 150 into a second profile (e.g., FIG. 4). In yet further embodiments, the switch 156 may include 3, 4, 5, 6, 7, 8, 9, 10, or more positions each automatically snapping the handle 150 into a different profile (e.g., different angle A).

The ability to pivot the handle 150 through the various angles so that the handle snaps into multiple configurations, as facilitated by the mechanical switch 156, enables changing the shape and dimensions of the spray gun 12 to accommodate various operational scenarios. For example, the configuration of the handle 150, as shown by FIG. 3, may enable the user to conveniently spray coat surfaces that are perpendicular relative to the spray gun 12. In contrast, the configuration shown by FIG. 4, may enable the user to spray coat surfaces that are obliquely situated relative to spray gun 12. Hence, the adjustable feature of the spray gun 12 offers a user multiple gripping postures for easily holding and using the spray gun 12. The convenient handling of the spay gun 12 is further facilitated by the handle 150 which is uniquely shaped to provide the user an ergonomic grip. This further renders the spray gun 12 as a versatile spray coating device, adaptable for use in a variety of situations otherwise not conveniently suited for conventional spray coating devices. In addition, the ability to adjust (e.g., rotate) the handle 150 and, thus, reshape the spray gun 12 can adapt the spray gun 12 to fit within multiple types of storage devices, such as tool boxes and the like. For example, the user may fit the spray gun 12 within a portable tool box, thereby enabling the user to carry the spray gun 12 between job sites.

As further illustrated, the spray gun 12 includes a plurality of components some of which may be modular. For example the casing 154 may be made up of a pair of modular casings that are generally symmetrical mirrored structures forming an enclosure defined by the casing 154. The casing 154 is adapted to enclose and support various modular components disposed within the space provided by the casing 154. In other embodiments, the single casing 154 may be defined by a plurality of different modular casings, each having a different shape, size, exterior features, interior features, fasteners, and so forth. The casing 154 may be formed of a lightweight plastic material, a rubber material, a metal such as aluminum, or a combination thereof. The casing 154 may be formed via various molding processes, such as injection or cast molding processes, in which a plastic, rubber, and/or metal may be conformed to the shape of the casing 154.

As further illustrated, the spray gun 12 includes a trigger 160 disposed adjacent to the handle 150. The trigger 160 is also adapted to pivot about the pivot point 152, enabling the trigger 160 to rotate together with the handle 150 as it pivots between the varying angle A, as shown by FIGS. 3 and 4. Further, in an exemplary embodiment, the trigger 160 is formed to attain a "clamshell" shape (e.g., semi-spherical or concave) that curves backward toward the handle 150, thereby providing the user with an ergonomic grip and a robust squeezing leverage. This enables the user to hold and operate the spray gun for prolonged periods of time. The unique clamshell shape of the trigger 160 and the manner in which the trigger 160 is disposed relative to the handle 150 enables the user to fully actuate the trigger 160 in all the spray gun's angular positions. In other words, the amount of leverage provided by the trigger 160 remains unchanged even though the angle A varies between the handle 150 and the casing 154.

The spray gun 12 further includes an air inlet adapter 162 and a fluid inlet adapter 164 disposed at the bottom of the handle 150. The air fluid adapter 162 is adapted to couple to an air supply providing pressurized air to the spray gun 12. The air supplies couplable to the adapter 162 may include pressurized air canisters, compressors, and so forth. Similarly, the fluid inlet adapter 164 is adapted to couple to a fluid supply, such as a fluid canister, providing the spray gun 12 fluid including paint, coatings, sealants, etc. The air and spray fluid provided by the supplies couplable to the adapters 162 and 164, respectively, are fed through the spray gun 12, and are eventually mixed to form a spray having a desirable spray profile downstream of tip exit 168.

As illustrated, the tip exit 168 is part of the air cap 170 disposed at a front end portion of the spray gun 12. In an exemplary embodiment, the tip exit 168 may be part of a spray tip module that includes atomization and fluid break up mechanisms configured to further optimize the manner by which a spray is formed as the fluid exits spray gun 12. As further illustrated, the air cap 170 and fluid tip exit 168 are retained to the casing 154 via retaining ring 172. In the illustrated embodiment, the ring 172 is threaded onto the front portion of the modular casing 154, while other embodiments may use other fasteners. The spray gun 12 may include additional modular components coupleable to one another in a manner which facilitates full assembling or disassembling of the spray gun 12. For example, the air cap 170 may enclose an air/fluid module including fluid and air inlets. passages, valves, and so forth. In addition, the air/fluid module contained within the air cap 170 may include fluid mixing structures, such as internal air jets directed toward fluid flows, air-driven mixing structures, internal fluid passages having variable geometries, impinging liquid jets, or a combination thereof. In some embodiments, the air/fluid module and/or cap 170 may be outfit with gravity feed connectors, such as a topside connector for a liquid canister. In addition, the air/fluid module can be coupled to modular control units for controlling the flow of air/fluid into in the spray gun 12. Accordingly, the modularity of the air cap 170 and other components of the spray gun 12 may be particularly advantageous, because it provides individual access, replacement, servicing, and maintenance of the various functional components of spray gun 12.

Figure 5:
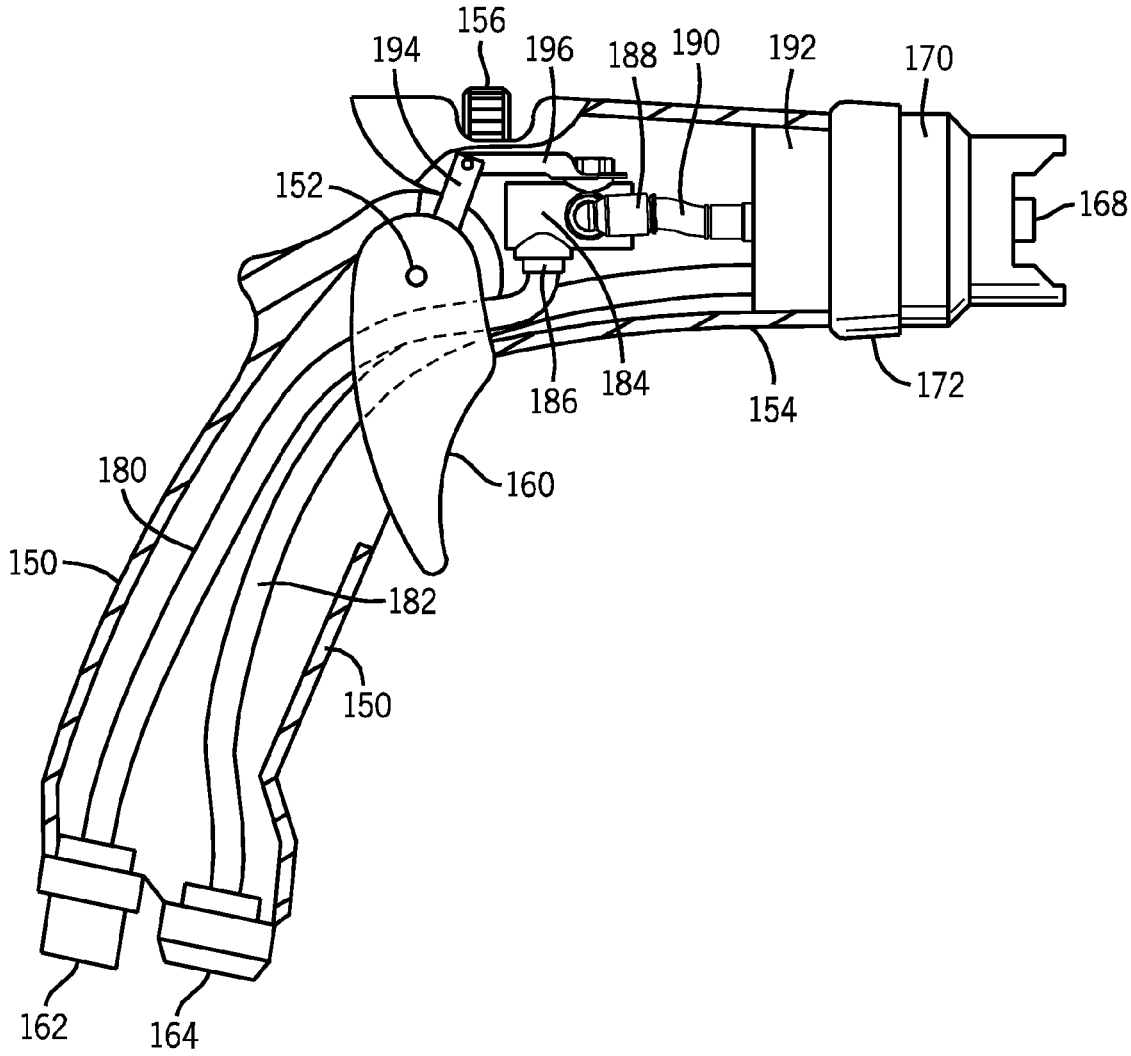
FIG. 5 is a cross section view of an embodiment of an adjustable handle spray gun.

FIG. 5 is a cross section view of the spray gun 12 in accordance with an embodiment of the present technique. Accordingly, FIG. 5 depicts inner components and the manner by which those components are coupled to one another within the adjustable handle spray gun 12. As illustrated, the handle 150 defines a space enclosing air tubing 180 and fluid tubing 182. The tubings 180 and 182 are configured to deliver air and coating fluid from the adapters 162 and 164, respectively, to the upper portions of the spray gun 12. Accordingly, the tubings 180 and 182 are flexible to enable the tubings 180 and 182 to bend, rotate, and flex as the handle 150 pivots through various positions. In other words, by virtue of their flexibility, the tubings 180 and 182 remain coupled to their respective components within the spray gun 12, as the handle 150 changes its configuration relative to the casing 154. In this manner, when the spray gun 12 acquires a configuration similar to that illustrated, for example, in FIG. 3, the air and fluid initially enters and flows within the spray gun 12 in a direction perpendicular to the direction of fluid/spray exiting the spray gun 12. By further example, when the spray gun 12 acquires the configuration similar to that shown in FIG. 4, the direction of the air and fluid entering and flowing within the spray gun 12 is parallel to the direction of the fluid/spray exiting the spray gun 12.

As further illustrated, the air tubing 180 couples the air inlet adapter 162 to an air valve module 184, which includes coupleable modular connectors 186 and 188. The modular connector 186 couples the tubing 180 to the air valve module 184, enabling pressurized air to flow from a pressurized air supply to the valve module 184. The air valve module 184 may further include modular components, such as a air control module having fan air control valves adapted to regulate the amount of pressurized air flowing into the spray gun 12. Such air flow regulation may ensure that proper amounts of air and spray fluid are mixed to form a desirable spraying profile. For example, in some embodiments, the fan air control module may include one or more pinch valves, which externally compress or pinch a flexible tubing to open and close the fluid and/or air flow. In this manner, valves are employed to regulate the amount of air flowing through the valve 184 and out to the modular connector 188. Further, the modular connector 188 is adapted to deliver the pressurized air, via tubing and adapter 190, from the air valve 184 to an air/fluid module 192, such as the above mentioned air/fluid module enclosed by the air cap 170. The air/fluid module 192 may be coupled to additional modular components enclosed by the air cap 170. Such components may include a modular nozzle, such as a pintle nozzle, incorporating the fluid tip exit 168. The pintle nozzle may be used in conjunction with air atomization systems for transforming fluid provided by a fluid source into very fine droplets as the coating fluid exits the spray gun 12 via exit 168.

As mentioned above, the fluid tubing 182 facilitates fluid delivery to within the spray gun 12. As illustrated, the tubing 182 is directly coupled between the fluid inlet adapter 164 and the air/fluid module 192. In this manner, spray fluid is directly delivered from a fluid source to the air/fluid module 192, where the fluid mixes with the pressurized air provided by the tubing 190. Thereafter, the spray and fluid mixture is provided to tip exit 168, where the mixture exits to form a desired spray coat.

The exemplary embodiment illustrated in FIG. 5 also depicts the manner by which the trigger 160 is coupled to the air valve 184 for enabling pressurized air to flow within the spray gun 12. Particularly, the trigger 160 is coupled to a lever 194, which in turn is coupled to adapter 196 directly coupled to the air valve 184. Accordingly, when the user actuates the trigger 160, motion of the trigger 152 is imparted onto the lever 194, thereby actuating the adapter 196 for controlling the flow of air entering the air/fluid module 192. Once the user actuates the trigger 160, pressurized air flows into the air/module 192. The air flowing within the air/fluid module 192 may in turn receive or draw spray fluid from the tubing 182 into the air/fluid 192 where the air and spray fluid mix and exit the tip exit 168 to form a spray coat.

Hence, the spray gun 12 has an adjustable profile attributed to the pivotal handle 150, such that the spray gun 12 can operate in various configurations, such as those shown in FIGS. 3-4. In addition, the modular components included within the spray gun 12 are adapted to be replaced and/or removed from the spray coating device with relative ease and with minimal disassembly of components that are coupled or are otherwise adjacent to the replaced components. For example, decoupling tubings 180 and 182 from adapters 186 and air/fluid module 192, respectively, may be done while leaving the air valve 184 and the air/fluid module 192 in place. Similarly, replacing the trigger 160 with a different trigger (for example, to accommodate different gripping sizes) may be performed by decoupling the trigger 160 from the pivot joint 152 while maintaining the lever 194 and the adapter 196 in place. As further illustrated, the disclosed embodiments provide for a spray gun 12 having no machined or drilled passages permanently formed as part of the spray coating device. This further simplifies replacing, for example, tubing which may have become damaged, blocked, or otherwise degraded over time.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system for spraying a coating fluid, comprising:

a spray coating device, comprising:

a hollow body having a valve module;

a spray head coupled to the hollow body, wherein a first axis extends through the hollow body and the spray head;

a hollow handle coupled to the hollow body, wherein the hollow handle comprises a user engageable trigger configured to actuate the valve module, and a second axis extends through the hollow handle;

a pivot joint having only a single axis of rotation between the hollow body and the hollow handle, wherein the pivot joint enables pivotal motion of the hollow handle relative to the hollow body over a range of movement, wherein the single axis of rotation enables the first and second axes to move between first and second angles in a common plane over the range of movement, the first and second axes are substantially perpendicular to one another at the first angle, and the first and second axes are substantially aligned with one another at the second angle; and at least one flexible fluid tube extending internally through the hollow body and the hollow handle, wherein the at least one flexible fluid tube extends internally through the spray coating device across the pivot joint between the hollow body and the hollow handle.

2. The system of claim 1, wherein the spray head is coupled to a first end of the hollow body, the pivot joint is coupled to a second end of the hollow body, and the first axis extends from the first end internally through the hollow body to the second end.

3. The system of claim 1, wherein the range of movement comprises a plurality of angular positions between the first and second axis, wherein the spray coating device is configured to output a spray of the coating fluid in all of the plurality of angular positions.

4. The system of claim 1, wherein the hollow body is substantially straight, the handle is substantially straight, the first angle is approximately 90 degrees, and the second angle is approximately 180 degrees.

5. The system of claim 1, comprising a switch adapted to lock and unlock the hollow handle relative to the hollow body at an angular position of the first axis relative to the second axis.

6. The system of claim 1, wherein the user engageable trigger protrudes from the hollow handle, and the user engageable trigger comprises a clamshell trigger having a concave geometry that curves back toward a front of the hollow handle.

7. The system of claim 1, wherein the valve module comprises a self-contained valve unit coupled to the at least one flexible fluid tube.

8. The system of claim 1, wherein the at least one flexible fluid tube extends directly across the pivot joint from a first opening in the hollow body directly to a second opening in the hollow handle, and the at least one flexible fluid tube comprises a flexible air tube, a flexible liquid tube, or both.

9. The system of claim 1, wherein the spray head comprises a fluid tip module having a liquid exit and an air exit, and the fluid tip module is coupled to the hollow body.

10. The system of claim 1, comprising a lever coupled to the user engageable trigger and the valve module, wherein the lever extends internally through the spray coating device across the pivot joint.

11. A spray gun, comprising:

a body comprising a valve;

a spray head coupled to the body, wherein a first axis extends through the body and the spray head;

a handle comprising a trigger, wherein a second axis extends through the handle;

a pivot joint having a only single axis of rotation connecting the body to the handle, wherein the pivot joint is configured to enable the handle to move with a pivotal motion among a plurality of angular positions relative to the body, the single axis of rotation enables the first and second axes to move along a common plane during the pivotal motion among the plurality of angular positions, the plurality of angular positions comprise a generally aligned position and a generally perpendicular position of the handle relative to the body, and the trigger is configured to actuate the valve across the pivot joint; and a first flexible fluid conduit extending through the spray gun from the handle internally to the body.

12. The spray gun of claim 11, wherein the spray head comprises a fluid tip exit axially aligned with the first axis.

13. The spray gun of claim 11, wherein the first and second axes are parallel with one another in the generally aligned position, and the handle is extended away from the body in the generally aligned position.

14. The spray gun of claim 11, comprising a second flexible fluid conduit extending through the spray gun from the handle internally to the body, wherein the first flexible fluid conduit comprises a flexible liquid conduit, and the second flexible fluid conduit comprises a flexible air conduit.

15. The spray gun of claim 14, wherein the handle comprises a liquid inlet and an air inlet, the flexible liquid conduit extends from the liquid inlet internally through the handle and the body to the spray head, and the flexible air conduit extends from the air inlet internally through the handle and the body to the spray head.

16. The spray gun of claim 11, wherein the body, the handle, or a combination thereof, comprises at least one shell defining an interior volume configured to enclose modular components of the spray gun, wherein the modular components comprise the valve.

17. The spray gun of claim 11, wherein the spray head comprises an air atomization mechanism.

18. The spray gun of claim 11, wherein the trigger comprises a clamshell trigger disposed adjacent the handle and adapted to pivot with the handle about the pivot joint, the clamshell trigger protrudes from the handle, and the clamshell trigger comprises a concave geometry that curves back toward a front of the handle.

19. The spray gun of claim 11, wherein the plurality of angular positions comprises a plurality of discrete angular positions that click or snap into place.

20. A spray gun, comprising:

a body;

a spray head coupled to the body, wherein a first axis extends through the body and the spray head;

a handle comprising a second axis;

a pivot joint having a only single axis of rotation connecting the body to the handle, wherein the pivot joint is configured to enable rotation of the handle relative to the body over a range of movement, wherein the single axis of rotation enables the first and second axes to move between first and second angles in a common plane over the range of movement, the first and second axes are substantially perpendicular to one another at the first angle, and the first and second axes are substantially aligned with one another at the second angle; and a first flexible fluid conduit extending through the spray gun from the handle internally to the body.

21. The spray gun of claim 20, wherein the first angle is approximately 90 degrees, and the second angle is approximately 180 degrees.

22. The spray gun of claim 20, wherein the first flexible fluid conduit is configured to bend inside the spray gun across the pivot joint while the handle rotates over the range of movement relative to the body.

23. The spray gun of claim 20, comprising a second flexible fluid conduit extending through the spray gun from the handle internally to the body, wherein the first flexible fluid conduit comprises a flexible liquid tube coupled to a liquid inlet into the handle, and the second fluid conduit comprises a flexible air tube coupled to an air inlet into the handle.

24. The spray gun of claim 20, comprising a clamshell trigger disposed adjacent the handle, wherein the clamshell trigger and the handle are configured to pivot together about the pivot joint, and the clamshell trigger comprises a concave geometry that curves back toward a front of the handle.

25. The system of claim 20, comprising a lever coupled to a trigger and a valve module, wherein the lever extends internally through the spray gun across the pivot joint.

* * * * *